US008685111B2

(12) United States Patent
Bagiran et al.

(10) Patent No.: US 8,685,111 B2
(45) Date of Patent: Apr. 1, 2014

(54) ENVIRONMENTALLY FRIENDLY TANNING COMPOSITION

(71) Applicant: Kemira Oyj, Helsinki (FI)

(72) Inventors: Cuneyit Bagiran, Tilburg (NL); Dominicus Brendler, Aschaffenburg (DE); Frank Wegener, Bedburg-Hau (DE)

(73) Assignee: Kemira Oyj, Helsinki (FI)

( * ) Notice: Subject to any disclaimer, the term of this patent is extended or adjusted under 35 U.S.C. 154(b) by 0 days.

(21) Appl. No.: 13/628,202

(22) Filed: Sep. 27, 2012

(65) Prior Publication Data

US 2013/0081211 A1 Apr. 4, 2013

(30) Foreign Application Priority Data

Sep. 30, 2011 (EP) ..... 11183499

(51) Int. Cl.
*C14C 3/00* (2006.01)

(52) U.S. Cl.
USPC ..... 8/94.19 R; 8/94.26; 8/94.29

(58) Field of Classification Search
USPC ..... 8/94.19 R, 94.26, 94.29
See application file for complete search history.

(56) References Cited

U.S. PATENT DOCUMENTS 4,285,689 A * 8/1981 Siegler ..... 8/94.26
2009/0275789 A1 11/2009 Cao et al.

FOREIGN PATENT DOCUMENTS

| | | |
|---|---|---|
| EP | 0439006 | 7/1991 |
| GB | 2106482 | 4/1983 |
| JP | 2000192088 | 7/2000 |

OTHER PUBLICATIONS

Costantini, et. al; Studies on the Tanning Reactions of Zeolite, (2000).
Office Action cited in European Application No. 11183499.0, (2012).

* cited by examiner

*Primary Examiner* — Eisa Elhilo
(74) *Attorney, Agent, or Firm* — Thomas Horstemeyer LLP

(57) ABSTRACT

An embodiment of the present disclosure relates to a composition suitable for leather tanning comprising zeolite treated with monocarboxylic acid and to a method for manufacturing said composition. An embodiment of the present disclosure method comprises providing zeolite into a reactor and keeping said zeolite in motion while introducing concentrated monocarboxylic acid thereto provided that the mean temperature of the resulting composition is 50° C. or below.

22 Claims, 1 Drawing Sheet

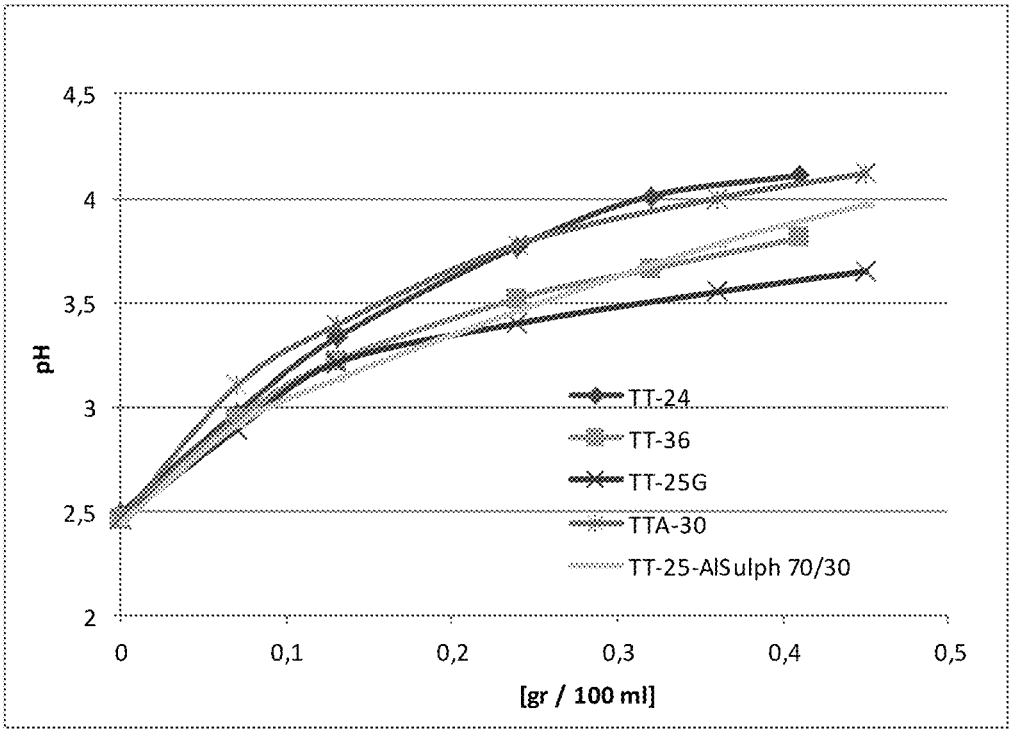
4,5
4
3,5
3
2,5
2
pH
0
0,1
0,2
0,3
0,4
0,5
[gr / 100 ml]
TT-24
TT-36
TT-25G
TTA-30
TT-25-AlSulph 70/30

ENVIRONMENTALLY FRIENDLY TANNING COMPOSITION

CROSS REFERENCE TO RELATED APPLICATION

This application claims priority to EPO No. 11183499.0, filed on Sep. 30, 2011, entitled "Environmentally Friendly Tanning Composition", which is incorporated by reference in its entirety.

BACKGROUND

Tanning is one process stage in manufacturing animal skins into durable leather. In tanning the protein structure of the skin is permanently altered. The tanning process aims at, in addition to avoiding rottening of the skin, increasing resistance to water, humidity and usage together with increasing flexibility, anti-allergenic properties and visual attractiveness. Pretreatment processes are required before tanning can take place such as splitting, deliming and/or pretanning processes like bating, decreasing, frizing and bleaching which are typically included in the processing stages.

There are three dominating tanning methods; aldehyde or synthan tanning, mineral tanning predominated by chrome tanning and vegetable tanning. Each of these tanning agents produces leathers with different properties. However, increasingly environmentally friendly solutions such as chrome or aldahyde free tanning agents are favoured, especially within e.g. automotive industry.

Chrome tanning with basic chrome sulphate is used in 85% of the world's tanned leather processing. A major advantage in this approach is the very high shrinkage temperature, 100° C. or more, provided to the finished leather by the method. The major future drawback will be the environmental problems related to the use of chromium and depletion of the availability of the ore. The visual appearance of bluish hue in colour is another unwanted product feature. In chrome tanning the chromium salts crosslink collagen protein molecules which make the hides less susceptible to effects of heat and putrefaction. The chrome tanning process, however, requires use of additional chemicals such as buffering and basification solutions. Prior to the introduction of the basic chromium, several steps are required to produce a tannable hide including scudding, liming, introduction of alkali agents such as sodium hydroxide, deliming, restoring neutral pH, bating, or softening the skin with enzymes, pickling i.e. lowering pH of the hide with salt and sulphuric acid. The pH is very acidic when the chromium is introduced to ensure that the chromium complexes are small enough to fit in between the fibres and residues of the collagen. Once the desired level of penetration of chrome into the hide is achieved, pH of the material is raised again i.e."basified" to facilitate the process. At this stage, the chrome tanned skins obtain the bluish colour.

Modern chrome-free mineral tanning comprises the use of sodium aluminium silicates (NAS) providing tanned leather with whitish colour hue. Synthetic zeolites have been tested also providing durable, resistant, readily machine processable, shavable and dimensionally stable leather products. A typical drawback in these processes is the lowered shrinkage temperature, TS, of the hides compared to chrome tanning due to formation of less stable complexes with collagen.

Vegetable tanning is an earlier process to mineral tanning the name originating from the use of tannin in the process. Tannins bind to the collagen proteins in the hide and coat them causing them to become less water-soluble, more resistant to bacterial attack, and increasing the hide flexible. This tanning method is, however, quite slow and has been largely overcome by the more efficient chrome tanning which is faster, taking less than a day, and produces a stretchable leather which is excellent for use e.g. in handbags and garments. Vegetable tanning is still in use for e.g. furniture and luggage leathers.

In aldehyde tanning amino groups of collagen are reacted with aldehydes. The shrinkage temperature obtained is adequate, about 75° C., but the colour hue of the tanned hide is yellowish, or sometimes even orange. The major drawback is that the hide can only partly be modified. Aldehyde tanning is typically used in conjunction with other tanning agents but it is not suitable as the sole tanning agent. The possible formaldehyde release is another concern. Specifically, this is an issue in the automotive and toy industry wherein strict concentration limits have been imposed.

Costantini et al., "Studies on the tanning reactions of zeolite" in JALCA, vol. 95, 2000, pp. 125-137 discloses a study on the reactions involved in pretanning or tanning when using zeolite based masking agents. The hydrothermal stability of sodium aluminum silicate is considered to be too low for use in tanning solely by a zeolite. The role of pH and acidic solutions in aluminosilicate breakdown are emphasized and discussed in detail. Maleic acid and phthalic acid are considered the only possible carboxylic acids to elevate the shrinkage temperature to an acceptable level. The shrinkage temperatures are determined by differential scanning spectroscopy. The hides are pretanned before the actual tanning.

One pre-tannage system for leather includes treating the hide with a zeolite material, such as sodium aluminium silicate in a first pre-tannage step and thereafter treating the hide with one or more modified aldehyde tanning agents. At this stage, the hide is suitable for a number of different tanning steps namely chrome tannage, vegetable tannage, synthetic tannage or combinations thereof.

Sodium aluminium silicate used for tanning leather must be added in the acidic phase with the result that it hydrolyses to alkaline aluminium salts and polysilicic acids. As the sodium aluminium silicate has not enough time to fully penetrate into the skin and become an active tanning agent prior to the decomposition, the tanning action will be restricted to the outer layers of the hide.

Others have disclosed a process of tanning for the production of dressed fur skins. In this process pickled fur skins are subjected to the action of an aqueous liquor containing tanning agents. A water-insoluble aluminosilicate containing bound water, of the formula $(Cat_{2/n}O)_x.Al_2O_3.(SiO_2)_y$ wherein Cat represents a cation selected from the group consisting of alkali metals, bivalent metal ions, trivalent metal ions and mixtures thereof; n represents an integer from 1 to 3; or x is a number of from 0.5 to 1.8; and y is a number of from 0.8 to 50, is added to the pickling bath as the tanning agent. Auxiliary tanning agents such as chrome and further chemicals such as carboxylic acids having at least two carboxyl groups may be added into the pretanning stage and tanning.

SUMMARY

Embodiments of the present disclosure provide for leather tanning compositions (also referred to as "composition"), methods of making leather tanning compositions, and the like.

An embodiment of the method for manufacturing a composition suitable for leather tanning comprising zeolite treated with concentrated monocarboxylic acid, among others, includes, (i) providing zeolite having a Si to Al ratio of about 0.7 to 2.5 into a reactor, and (ii) keeping said zeolite in motion while introducing concentrated monocarboxylic acid selected from the group of consisting of: formic acid, acetic acid, propionic acid, glycolic acid, lactic acid, and a mixture thereof, wherein the concentration of said monocarboxylic acid being more than about 84% by weight, thereto provided that the mean temperature of the resulting composition is maintained at a temperature of about 50° C. or below.

An embodiment of the composition, among others, includes, a leather tanning composition obtained by a method as described herein, wherein the leather tanning composition is in a form of a powdery solid having a moisture content less than about 20% by weight comprising zeolite having a Si to Al ratio of about 0.7 to 2.5 treated with concentrated monocarboxylic acid selected from the group consisting of: formic acid, acetic acid, propionic acid, glycolic acid, lactic acid and mixtures thereof, wherein the concentration of said monocarboxylic acid being more than about 84% by weight, and having the zeolite structure intact.

In an embodiment, the composition is a toxic free composition suitable for tanning leather and providing an adequate shrinkage temperature performance.

In an embodiment, the composition is a cost efficient and easy-to-handle composition suitable for tanning leather.

In an embodiment, the composition provides a chrome-free tanning agent composition for producing enhanced quality leather.

In an embodiment, the method for manufacturing the composition is suitable for tanning leather and has an adequate shrinkage temperature performance.

In an embodiment, the composition is an environmentally friendly composition suitable for tanning leather.

In an embodiment, a method is provided for manufacturing an environmentally friendly composition, such as those described herein.

In an embodiment, it was found that using the composition of the present disclosure for tanning that the zeolite which has been modified by e.g., formic acid, and preferably with a metal salt such as an acidic aluminium salt, results in effective tanning. The hide is tanned not merely from the surface thereof but the tanning agent is able to penetrate deeper into the hide. The pH increase in the hide is slow due to controlled acid release from the zeolite structure.

FIGURES

FIG. 1 shows the pH of the tanning solution as a fuction of the amount and quality of added tanning agent according to example 8.

DETAILED DESCRIPTION

Embodiments of the present disclosure provide for leather tanning compositions (also referred to as "composition"), methods of making leather tanning compositions, and the like.

An embodiment of the present disclosure includes a composition which is able to replace chromium compounds in tanning is provided. In addition, the composition of the present disclosure is able to simultaneously replace the buffering and/or basification agents required in e.g. chrome tanning process. The composition of the present disclosure can thus be used instead of all the three typically used chemicals; basic chromium sulphate, the buffer and the base, which will streamline the tanning process considerably and reduce processing costs.

A further advantage in using a composition according to the present disclosure is that the colour hue of the final leather will be whitish instead of being bluish as is the case in chrome tanning.

An embodiment of the composition of the present disclosure comprises a zeolite, which is specifically treated with a monocarboxylic acid. In an embodiment, the monocarboxylic acid is preferably concentrated monocarboxylic acid, which is specifically impregnated or diffused into the zeolite structure i.e. reacted with the used zeolite. In an embodiment, the monocarboxylic acid is selected from formic acid, acetic acid, propionic acid, glycolic acid, lactic acid or mixtures thereof. In an embodiment, the use of a lower monocarboxylic acid may be advantageous, which is contrary to the prior teachings such as e.g., Costantini et al., as it provides an enhanced ability to penetrate into the zeolite structure and pores therein compared to higher monocarboxylic acids.

In one embodiment the monocarboxylic acid is selected from formic acid or acetic acid, and preferably the monocarboxylic acid is formic acid.

In an embodiment, the composition of the present disclosure is especially suitable for uses wherein an acidifying compound is required, preferably in tanning of leather.

In order to provide as effective acidity as possible per unit volume and as efficient acidifying and tanning response as possible, the use of concentrated monocarboxylic is favoured. In an embodiment, the concentration of the monocarboxylic acid to be used is about 84% by weight or more, preferably about 90% or more, more preferably about 95% or more, most preferably about 99%.

In an embodiment, a concentrated acid is preferred in order to provide as low moisture content for the end product as possible. The dry or dried zeolite is preferred as moisture affects, for example, handling properties of the powdery product such as flowability.

In a preferred embodiment, the composition is a reaction product of zeolite with concentrated formic acid, preferably about 99.5% by weight formic acid, and is depicted by formula 1:

$$NaAlSiO_4.xH_2O+xHCOOH \quad (1)$$

This reaction can lead to formation of sodium formate, NaCOOH, and an acidified zeolite, $H_2Al_2O_4.SiO_2.xH_2O$, but in analysis of the produced composition no sodium formate could be detected. Moreover, no characteristic odour of free formic acid could be detected in the formed compound suggesting that no free formic acid is present.

Furthermore, the zeolite structure remains intact after the treatment with monocarboxylic acid i.e. the analysis shows that no breakdown or disintegration takes place. As the pore volume of the zeolite varies the amount of carboxylic acid readily impregnated may vary accordingly.

In an embodiment, the structures and reactivity of zeolites can be modified by confining specific molecules into the small pores therein. For example, hydrogen form of zeolites typically prepared by ion exchange are powerful solid state acids and can facilitate to host acid catalysed reactions. Synthetic zeolites can be tailor made to fulfil the desired specific uses. Presently, about 200 unique zeolite frameworks are identified and over 40 naturally occurring frameworks are known.

The zeolites of the present disclosure comprise Al and Si oxides. The zeolite comprised in the composition of the present disclosure is preferably a basic zeolite. More preferably, the pH of the basic zeolite can be about 10. The zeolites to be used are microporous aluminosilicate minerals with open three dimensional framework structures built of $SiO_4$ and $AlO_4$ tetrahedra linked to each other by shearing all the oxygen atoms to form regular intra crystalline cavities and channels of molecular dimensions. These frameworks are typically negatively charged and attract positive cations that reside in cavities to compensate the negative charge of the framework. Preferably, alkali metals or earth alkaline metals are included into the zeolites of the present disclosure. More preferably the zeolites comprise Na, K, Ca or Ba aluminosilicates.

The ratio of Si to Al in the zeolite is from about 0.7 to 2.5. Preferably, the ratio can be about 0.7 to 1.2, and more preferably about 0.7 to 1.1 such as about 0.9 to 1.1 or very close to unity.

In another preferred embodiment the alkali or earth alkaline metal:Si:Al ratio of the zeolite is about 1:1:1, the alkali metal being preferably sodium.

In one embodiment the zeolite is selected from the group of: faujasit, zeolite A, and mordenite, zeolite X, which have a nearly maximal aluminium content possible in the tetrahedral framework, or the mixtures thereof. Preferably the zeolite is type A. The number of cation exchange sites is the highest in these zeolites rendering them highly selective for polar or polarizable molecules.

In another embodiment the zeolite is selected from zeolites defined by their CAS numbers of 1344-00-9, 1318-02-1 and/or 1318-02-1.

The zeolite according to the present disclosure has a low moisture content of less than about 20% by weight, more preferably less than about 10%, most preferably less than about 7%, such as less than about 5%, or even about 4% or less. The zeolite may be dried, preferably oven dried, before subjecting it to monocarboxylic acid treatment.

According to one embodiment zeolite A4 having a pore size of 4 Å is preferred. Especially, the combination of oven dried zeolite A4 treated with formic acid was found to exhibit an excellent performance.

In an embodiment, the ratio of monocarboxylic acid to zeolite is preferably about 5 to 40% by weight. The ratio may be to some extent dependent on the quality of the acid used. For formic acid the more preferred ratio is about 7 to 30%, most preferably about 8 to 28%, such as about 10 to 25%. The characteristic smell of formic acid becomes clearly evident when the ratio exceeds about 40% by weight. For acetic acid the more preferred ratio can be about 7 to 35%, most preferably about 10 to 34%, such as about 13 to 33%.

Preferably, the zeolites and the impregnated zeolites used according to the present disclosure do not include any heavy metals or toxic metals such as chrome.

In an embodiment, the tanning agent composition comprising the monocarboxylic acid treated zeolite may further comprise co-tanning agents. These co-tanning agents can include inorganic salts enhancing the required pH behaviour of the composition in aqueous tanning stage. These solid state salts can comprise pH buffering salts, preferably metal sulphates, more preferably aluminium sulphate. Aluminium sulphate forms sulphuric acid upon dissolution in water and aids in lowering and stabilising the pH. Furthermore, co-tanning agents may include solid carboxylic acids, preferably citric acid, ortophosphoric acid, salicylic acid, lactic acid or polyaluminium silicate sulphate (PASS). Moreover, organic boosters, preferably glutaraldehyde (tetrakis hydroxymethyl phosphonium sulphate, THPS) or a low molecular weight resin, preferably methylol resins, may be used as co-tanning agents.

In a preferred embodiment the tanning agent composition further comprises aluminium sulphate. The sulphate salt aids in buffering the tanning solution and results in enhanced performance in combination with the monocarboxylic acid, preferably formic acid, treated zeolite. The rise in pH during tanning is delayed and the tanning procedure is more controlled when using sulphate salt addition. The hide becomes tanned to the core and the tanning is more efficient. In an embodiment, the tanning effect can be restricted to the hide surface if mere zeolite is used without the monocarboxylic acid, and the core may become inflexible and unyielding. Despite of the addition of a sulphate salt a monocarboxylic acid impregnation is required.

In an other preferred embodiment the tanning composition further comprises aluminium sulphate and THPS. The use of acidic aluminium salt supresses the pH increasing tendency aiding in perfecting the tanning. THPS contributes to the tanning effect by enhancing the collagen crosslinkage and, for example, inhibiting the mold growth.

The composition of the present disclosure is preferably essentially odourless. It preferably exhibits a pH of about 4 to 7, more preferably about 4, about 3 to 7 when dispersed in water.

The appearance of the material is a solid powder, and it has preferable the same flowability as the zeolite used as precursor i.e. the treatment according to the disclosure does not degrade the handling properties. The solid appearance provides handling advantage compared to e.g. liquid tanning agents. The tanning agent of the present disclosure has reasonable solubility in acidic aqueous solutions, especially at pH of about 2.5 which is the typical pH for tanning.

The addition of the composition according to the present disclosure into an aqueous tanning hide solution of pH about 2.8-3.5, preferably about 2.4, can provide self-buffering of the pH to a value of about 3.5 to 4.5 when dispersed into the mixture.

The composition according to the present disclosure has been found environmentally beneficial e.g. in tanning solutions as it simplifies the tanning process while retaining an overall affordable processing. Furthermore, this composition may absorb further liquids such as free formic acid, glutaraldehyde, methylol resins, and the like, that are known to be beneficial in tanning and leather finishing processes.

The composition of the present disclosure suitable for use as a tanning agent has the advantage that it can directly replace the chrome tanning agent typically used in the hide manufacturing process. No substantial changes into the process flow chart are required. In a typical mineral tanning process the hide is pickled with formic acid containing solution at a pH of about 2.8 to 3.4 before addition of the tanning agent. In an embodiment, this necessitates the use of a sodium formate buffer for buffering the solution, and a slow acting base such as magnesium oxide or sodium bicarbonate for basification in order to achieve the final pH close to about 4 for completing the tanning. The tanning agent of the present disclosure already contains the buffer. It dissolves at the pH about 2.8 to 3.4 into formic acid pickle and self-basifies to pH of about 4 in about 8 h. The use of the compound of the present disclosure thus removes the need for a separate buffering and/or basifying, as well.

An embodiment of the present disclosure also includes a method for manufacturing a composition suitable for leather tanning is provided. In this method zeolite is first introduced into a reactor, or another vessel suitable for withstanding the required treatment conditions. The provided zeolite is kept in motion while concentrated monocarboxylic acid is introduced onto the zeolite residing inside the reactor.

In an embodiment, the acid is introduced in a spray form i.e. slowly and uniformly enough to ensure that a homogenous solid powdery composition is obtained and maintained, similar to the original zeolite powder, and simultaneously the temperature of this mixture is controlled. The temperature of the mixture should stay low enough, at a critical value of about 50° C., preferably below about 50° C., to avoid unwanted reactions to take place as the treatment of the monocarboxylic acid with the zeolite is exothermic. Such unwanted reactions originate from heat peaks, and additionally, too high temperature causes volatilization of the acid. Unwanted reactions may comprise degradation of the zeolite structure such as decomposition, decreased effect of acid loading, formation of hard particles or other undesired or detrimental side effects.

By the term "spray" is meant a small droplet size atomised liquid flow. A spray is generally taken to mean a dynamic collection of drops dispersed in gas. The process of forming a spray is called atomisation. A spray nozzle is typically used to generate a spray. The main characteristics of a spray are to distribute the material over a specified cross section and to generate a liquid surface area. A man skilled in the art is able to select the most appropriate spray technology depending on the reactor configuration.

Preferably, a suitable spray is provided by a nozzle atomizer capable of injecting a spreading spray with a small droplet size, preferably about 0.01 to 1 mm in diameter. The mass transfer rate of the acid may be adjusted by measuring the temperature of the resulting zeolite-acid mixture and setting the mass transfer rate into a value wherein this temperature is still below the critical value. Spraying may be performed continuously or discontinuously.

The zeolite needs to be in motion inside the reactor. Preferably, this motion is vigorous enough in order to ensure good uniformity for the acid contact and to avoid generation of local hot spots. A preferred option is to use a drum reactor or the like wherein the rotation speed may be adjusted according to the mixing needs. A skilled person is able to optimize the mixing to maintain a uniform temperature below the critical value.

In a preferred embodiment the reactor is equipped with a cooling system to ensure that the temperature of the mixture is maintained below the critical temperature. More preferably, a drum reactor with a cooling casing or jacket is utilised. There are several other commercially available options for cooling in a reactor set up suitable for the present use which may be applicable and within the expertise of a skilled person.

In a preferred embodiment the amount of the monocarboxylic acids sprayed onto the zeolite is within the ratio of about 5 to 50% by weight, more preferably about 7 to 35%, most preferably about 10 to 30%. The pore size and amount of the zeolite may cause some variation on the desired outcome.

In a preferred embodiment concentrated formic acid, most preferably about 99% by weight formic acid, is sprayed onto zeolite, preferably a basic zeolite of type A or X. The critical temperature in this case is about 50° C., preferably about 45° C., most preferably about 35° C. such as about 30° C.

In another preferred embodiment concentrated acetic acid, preferably about 99% by weight acetic acid, is sprayed onto zeolite, preferably a basic zeolite of type A or X. The critical temperature in this case is about 50° C., preferably about 45° C., most preferably about 35° C. such as about 30° C.

In yet another preferred embodiment concentrated propionic acid, preferably about 99% by weight propionic acid, is sprayed onto zeolite, preferably a basic zeolite of type A or X. The critical temperature in this case is about 50° C., preferably about 45° C., most preferably about 35° C. such as about 30° C.

When all the monocarboxylic acid is dosed into the reactor the reaction is completed. After cooling down to room temperature the product is ready. The product has a shelf life of at least several months, possibly years.

In a preferred embodiment metal sulphate, preferably aluminium sulphate, is added into the composition after providing the zeolite with the monocarboxylic acid. This addition aids in preserving or even lowering the final temperature of the composition which tends to increase due to the exothermic reaction between the zeolite and the monocarboxylic acid.

The present disclosure provides the use of this composition for leather treatment. This treatment is preferably tanning the hide.

In one embodiment when the hide has been pretreated by deliming and bating and it has passed the pickling stage having a typical pH of about 2.5 it is subjected to tanning. At this stage the composition of the present disclosure is added into the hide tanning vessel comprising an aqueous solution which is mainly water, preferably in an amount of about 5 to 20% by weight of the hide mass, preferably about 4 to 15%. The tanning compound is added and tanning is carried out. Subsequently, the hides are removed from the solution and the solution typically becomes waste.

In a preferred embodiment the processing sequence comprises (a) a depickling stage; (b) washing the hide; (c) a tanning including additions of water, formic acid and sulphuric acid before providing the zeolite tanning agent treated with monocarboxylic acid according to the present disclosure to the tanning solution. When using e.g., chrome tanning agent the tanning stage further comprises additions of further chemicals such as pretanning agents, buffering agents such as metal formates and/or basification agents such as metal bicarbonates. In using the zeolite treated with monocarboxylic acid as the tanning agent the need for these further chemicals becomes redundant.

One advantage in using the composition of the present disclosure as the tanning agent is that the waste solution will be chromium-free and can be easily exposed of, or even recycled. A further advantage is that the actual hide or leather product originating from the tanning process is also totally chrome-free.

A chrome-free leather is provided having a high shrinkage temperature, Ts, which is higher than about 65° C., preferably higher than about 70° C., more preferably higher than about 72° C., such as about 75° C., and which does not have a bluish colour hue but a whitish one. The chrome-free leather is advantageously obtained by the above described tanning method and composition. Preferably, the leather product obtained is tanned to the core and provides an especially soft touch sensation.

By shrinkage temperature, Ts, is meant a temperature measured according to ASTM D6076-08 Standard Test which method is designed to determine the temperature at which a thoroughly wetted leather specimen experiences shrinkage. Shrinkage occurs as a result of hydrothermal denaturation of the collagen protein molecules which make up the fiber structure of the leather. The shrinkage temperature of leather is influenced by many different factors, most of which appear to affect the number and nature of crosslinking interactions between adjacent polypeptide chains of the collagen protein molecules. The value of the shrinkage temperature of leather is commonly used as an indicator of the type of tannage or the degree of tannage, or both. In the present disclosure Ts is the temperature at which a thoroughly wetted leather experiences shrinkage.

The composition of the present disclosure i.e. zeolite treated with monocarboxylic acid is able to release said monocarboxylic acid into the ambient in an alkaline environment. When monocarboxylic acid, preferably formic acid, is contacted with hydrogen peroxide peracid, preferably performic acid, is formed. The formation of peracids does not typically occur unless an activator is present. The activator provides a slow release of monocarboxylic acid resulting in peracid formation in situ. Zeolite composition, preferably having a high Al to Si ratio, which is reacted with monocarboxylic acid is able to function as an activator.

The disclosure is further illustrated by the following non-limiting examples.

EXAMPLES

Example 1

A powdery, oven dried Zeolite A4 having Na:Si:Al ratio of 1:1:1 (from Industrial Chemicals Limited) was added into a turbulent mixer (Lödige VT(A) 300 paddle dryer) equipped with a cooling system. Concentrated formic acid, 99% by weight (Kemira Chemicals), was sprayed on the zeolite slowly and continuously while mixing the resulting composition vigorously. The reaction was completed when all formic acid was introduced into the mixture.

The following formic acid to zeolite ratios in weight % were tested:

Sample A: 1:3 i.e. 24.5% by weight formic acid and 75.5% by weight zeolite;

Sample B: 2:3 i.e. 40% by weight formic acid and 60% by weight zeolite;

Sample C: 3:7 i.e. 30% by weight formic acid and 70% by weight zeolite

The formic acid reacted exothermally with the zeolite. Temperature of the mixture was kept below 50° C. by efficient mixing and external cooling.

Free flowing solid powder was obtained which was free from formic acid smell in test A. Analysis showed that the test sample had 75.5% by weight of Zeolite 4A and 24.5% by weight of formic acid. Moreover, the zeolite structure was found to be intact.

Free flowing solid powder was obtained in test C. The sample had a slight acidic smell suggesting the presence of some free formic acid.

Solid powder with some spherical agglomerates was obtained in test B. The sample had a clear acidic smell suggesting the presence of free formic acid.

Example 2

A powdery, oven dried Zeolite A4 having Na:Si:Al ratio of 1:1:1 (from Industrial Chemicals Limited) was added into a turbulent mixer (Lödige VT(A) 300 paddle dryer). Concentrated acetic acid, 99% by weight (Kemira Chemicals) was sprayed on the zeolite slowly and continuously while mixing vigorously. The reaction was completed when all acetic acid was introduced into the mixture.

A sample of acetic acid to zeolite ratio of 1:2 i.e. 30% by weight of acetic acid to 70% by weight of zeolite was prepared.

The acetic acid reacted exothermally with the zeolite. Temperature of the mixture was kept below 50° C. by efficient mixing and external cooling.

Free flowing solid powder was obtained which was free from acetic acid smell. Analysis showed that the test sample had 70% by weight of Zeolite 4A and 30% by weight of acetic acid. Moreover, the zeolite structure was found intact.

Example 3

The product A of example 1 was introduced into pure water in concentration of 1% by weight. A whitish slurry was formed having pH of 5.86.

When this product was introduced into pure water in a concentration of 10% by weight a clearly white slurry was formed having pH of 5.78.

Example 4

Samples D and E were prepared the same way as in example 1 with the difference that the ratio of formic acid to zeolite was D: 24% to 76% by weight E: 36% to 64% by weight The samples were sieved to a particle size of below 125 μm. Two aqueous solutions were prepared by adjusting the pH thereof into 2.5 by addition of concentrated formic acid. Subsequently, samples D and E were gradually introduced into these solutions in increments of about 0.08 g.

Table 1 shows the results obtained.

| Cumulative amount of D or E in g | pH in D-solution | pH in E-solution | remarks |
|---|---|---|---|
| 0 | 2.49 | 2.46 | no remarks |
| 0.07 | 2.97 | 2.94 | white at start but becomes clear |
| 0.13 | 3.33 | 3.22 | white at start but becomes clear |
| 0.24 | 3.77 | 3.52 | white at start but becomes quite clear (little haze) |
| 0.32 | 4.01 | 3.66 | white at start but becomes clear (little haze) after a longer waiting period |
| 0.41 | 4.11 | 3.81 | white at start but becomes clear (little haze) after a long waiting period |

Example 5

Bovine hides were tanned in the conventional chrome tanning way using 1) chrome tanning agent (BCS) as a reference process, and
2) zeolite treated with formic acid prepared according to example 1 with the ratio of formic acid to zeolite 13% by weight formic acid and 87% by weight zeolite.

In the first chrome process a shrinkage temperature of 95° C. was obtained for the finished leather and in the second process with formic acid treated zeolite a temperature of 75° C. The color of the leather from the first chrome process was clearly bluish in comparison to the whitish color of the leather from in the second process.

Example 6

Three samples F, G and H were made according to example 1 with the exceptions of using 25 kg of zeolite and Sample F: 13% by weight formic acid (3.8 kg) and 87% zeolite Sample G: 25% by weight formic acid (7.9 kg) and 75% zeolite Sample H, 7.8% by weight formic acid (3.8 kg) and 40% aluminium sulphate (19.1 kg, below 280 μm particle size) and 52.2% zeolite.

Zeolite was first cooled to 20° C. and formic acid was sprayed into the mixer whereby the temperature inside the mixer was kept below 45° C. Aluminum sulphate was added after the formic acid feed. The formed mixtures were mixed further for half an hour.

It was found that adding aluminium sulphate resulted in decreasing the pH when the obtained solid powder was dispersed in water. A 1% by weight solution in water of sample H gave pH of 4.31 and for a 10% by weight solution the pH was 4.39 whereas sample and G provided pHs of 5.13 and 4.77, respectively.

Example 7

A comparison between three Cr-free tanning agents and the tanning agent according to the present disclosure was made. The process sequence depicted in table 2 was used.

The used tanning agent samples in the tanning step (X1 and X2) for preparation of tanned hides, were reference 1, AF-Z3: aluminium triformate and zeolite reference 2, PAF-Z4: basic aluminium formate and zeolite reference 3, PASS-Z0: basic aluminium sulphate with a silicate stabilizer with zeolite sample according to the present disclosure similar to example 1: zeolite A4+99% formic acid in a weight ratio of 75.5:24.5 zeolite to formic acid.

The process scheme for the reference samples 1-3 included additions of the buffering agent, Na-bicarbonate, in stage Y1 and Y2 whereas the process scheme for the samples according to the present disclosure did not include the additions of the buffering agent.

After processing according to the scheme in table 2 the end pHs of all the test solutions were measured to be the same, pH 4. The shrinkage temperatures for the finalized leathers were measured after 2 days of storage.

The shrinkage temperatures for reference 1, reference 2, reference 3 and the sample according to the disclosure were found to be 64, 58, 62 and 73° C., respectively.

These results clearly show the better tanning effect of the formic acid treated zeolite compared to the other chrome-free tanning agents. In addition to the higher shrinkage temperature the feel of the leather product was softer than the feel of the reference leather samples.

TABLE 2

| Process | g/l | Additive | t ° C. | min. | remark |
|---|---|---|---|---|---|
| | | Depickling | | | |
| Depickle | 100 | Water | 33 | | |
| | 2R/MIN | | | 60 | slow rotating drum |
| | 2 | Na-formate | | 30 | |
| | 0.5 | Na-bicarbonate | | 30 | |
| | 0.5 | Na-bicarbonate | | 30 | |
| | 0.5 | Na-bicarbonate | | 30 | |
| | 0.5 | Na-bicarbonate | | 30 | |
| | 0.5 | Na-bicarbonate | | 120 | pH = 7, Tc = 42 |
| | | Drain/Wash | | | |
| Wash | 40 | Water | 38 | | |
| | 3R/MIN | | | 90 | slow rotating drum |
| | 60 | Water | 38 | 30 | |
| | | Drain/Wash | | | |
| Wash | 40 | Water | 38 | | |
| | 3R/MIN | | | 90 | slow rotating drum |
| | 60 | Water | 38 | 30 | |
| | | Drain/Wash | | | |

TABLE 2-continued

| Process | g/l | Additive | t ° C. | min. | remark |
|---|---|---|---|---|---|
| | | Tanning | | | |
| | 100 | Water | 28 | | |
| | 1 | Formic acid | | 30 | |
| | 1 | Formic acid | | 30 | |
| | 0.2 | sulphuric acid | | 180 | pH = 3 |
| | X1 | Tanning agent, part 1 | | 60 | |
| | X2 | Tanning agent, part 2 | | 180 | |
| | 1.5 | Na-Formate | | 60 | |
| | Y1 | Na-bicarbonate | | 30 | |
| | Y2 | Na-bicarbonate | | 240 | |

Example 8

A set of five samples I, J, K, L and M were prepared according to example 1 with the exception of using in Sample I (TT-25): Zeolite and formic acid ratio of 75% to 25% with the maximum spraying temperature of 45° C.

Sample J (TT-36): Zeolite and formic acid ratio of 64% to 36% with the maximum spraying temperature of 45° C.

Sample K (TTA-30): Zeolite and acetic acid ratio of 70% to 30% with the maximum spraying temperature of 45° C.

Sample L (TT-25G): Zeolite and formic acid ratio of 75% to 25% with the maximum spraying temperature of 45° C. and grinding the resulting compound before dispersion.

Sample M (TT-25 AlSulph 70/30): Zeolite and formic acid ratio of 75% to 25% with the maximum spraying temperature of 45° C. and adding further aluminium sulphate to the composition at a weight ratio of 70 to 30 formic acid treated zeolite to aluminium sulphate.

The pH performance was studied by introducing the samples gradually in 0.08 g intervals into 100 ml of water made acidic (pH 2.5) by formic acid. The pH change resulting from the additions of these samples is shown in FIG. 1.

Example 9

Various tanning agent composition were tested according to the processing scheme of table 2. The processing parameters and the results measured from leather samples are shown in tables 3-5. Tests were made for probing the influence of the tanning agent composition modifications to shrinkage temperatures.

The reference samples include chrome tanning agent (BCS=basic chrome sulphate), ammonium products and aluminium sulphate products. The samples according to the present disclosure include formic acid and acetic acid treated zeolite A4 with no or further additions of orthophosphoric acid, citric acid and THPS (Fennocide). The treated leather was bovine hides (ZIG).

TABLE 3

| | Reference samples | | | Samples according to the present disclosure | | | | | | |
|---|---|---|---|---|---|---|---|---|---|---|
| Product name | Chromium product Basic chrome sulphate (BSC) | Commercial aluminium product (BASF) AF-Z3 | Aluminium sulphate product (Kemira), polyaluminium sulphate PASS-Z0 | TANFOR-T | TTA-30 | TTFP-12 | TT-C11 | TT-13 | TT-FC11 | *dublicate TT-13 (*) |
| Appearance | — | Liquid | Powder | Powder | Powder | Powder | Powder | Powder | Powder | Powder |
| Al2O3 [wt %] | — | 8.5 | — | — | — | — | — | — | — | — |
| SO4 [wt %] | — | 0 | — | — | — | — | — | — | — | — |

TABLE 3-continued

| | Reference samples | | | Samples according to the present disclosure | | | | | | |
|---|---|---|---|---|---|---|---|---|---|---|
| Product name | Chromium product Basic chrome sulphate (BSC) | Commercial aluminium product (BASF) AF-Z3 | Aluminium sulphate product (Kemira), polyaluminium sulphate PASS-Z0 | TANFOR-T | TTA-30 | TTFP-12 | TT-C11 | TT-13 | TT-FC11 | *dublicate TT-13 (*) |
| Basicity [%] | — | <5 | — | — | — | — | — | — | — | — |
| Dosage | Is BCS | 3.2 × dose of BCS | 1.0 × dose of BCS | 1.0 × dose of BCS | 1.0 × dose of BCS | 1.0 × dose of BCS | 1.0 × dose of BCS | 1.0 × dose of BCS | 1.0 × dose of BCS | 1.0 × dose of BCS |

TABLE 4

| Product name | Basic chrome sulphate (BSC) | AF-Z3 | PASS-Z0 | TANFOR-T | TTA-30 | TTFP-12 | TT-C11 | TT-13 | TT-13 | TT-13 (*) |
|---|---|---|---|---|---|---|---|---|---|---|
| PASS-10 S PolyAluminium Silicate Sulphate [%] | — | — | 100 | — | — | — | — | — | — | — |
| Zeolite-4A SodiumAluminoSilicate ($Na—Al—Si—O_4$) [%] | — | 6.7 | 0 | 75 | 70 | 75.5 | 75 | 87 | 73 | 87 |
| Water [%] | — | 65 | — | — | — | — | — | — | — | — |
| AluminiumTriFormate solid ($Al—(OCOH)_3$) [%] | — | 28.3 | — | — | — | — | — | — | — | — |
| Formic Acid 99% [%] | — | — | — | 25 | — | 12.5 | 11 | 13 | 11 | 13 |
| OrthoPhosphoric Acid 85% [%] | — | — | — | — | — | 12 | — | — | — | — |
| Acetic Acid 99.8% [%] | — | — | — | — | 30 | | — | — | — | — |
| Citric Acid anhydrous [%] | — | — | — | — | — | — | 14 | — | — | — |
| Fennocide PS 75 [%] | — | — | — | — | — | — | — | — | 16 | — |
| Dosage in tanning test (Cr tanning = 4.0 g/lt) | 4.0 | 12.8 | 4.0 | 4.0 | 4.0 | 4.0 | 4.0 | 4.0 | 4.0 | 4.0 |

TABLE 5

| Product name | Basic chrome sulphate (BSC) | AF-Z3 | PASS-Z0 | TANFOR-T | TTA-30 | TTFP-12 | TT-C11 | TT-13 | TT-13 | TT-13 (*) |
|---|---|---|---|---|---|---|---|---|---|---|
| Type of leather | ZIG | ZIG | ZIG | ZIG | ZIG | ZIG | ZIG | ZIG | ZIG | ZIG |
| Weight leather [gr] | 400 | 400 | 350 | 700 | 350 | 450 | 216 | 165 | 216 | 185 |
| Starting pH after dosing H2SO4 | 3 | 3 | 3 | 2.8 | 2.8 | 2.8 | 2.8 | 2.8 | 2.8 | 2.36 |
| Dosage Sample [%] and time [min] | 4.0/60 | 12.8/60 | 4.0/60 | 4.0/60 | 4.0/120 | 4.0/120 | 4.0/120 | 4.0/120 | 4.0/120 | 2.67/150 |
| Dosage Sample [%] and time [min] | 4.0/180 | 12.8/180 | 4.0/180 | 4.0/180 | 4.0/480 | 4.0/480 | 4.0/480 | 4.0/480 | 4.0/480 | 2.67/150 |
| Dosage Sample [%] and time [min] | — | — | — | — | — | — | — | — | — | 2.67/300 |
| Dosage SodiumFormate [%] and time [min] | 1.5/60 | 1.5/60 | 1.5/60 | 1.5/330 | — | — | — | — | — | |
| Dosage BiCarbonate [%] and time [min] | 1.0/30 | 1.0/30 | 1.0/30 | — | — | — | — | — | — | — |
| Dosage BiCarbonate [%] and time [min] | 1.0/240 | 1.0/240 | 1.0/240 | — | — | — | — | — | — | — |
| Total time [min] | 570 | 570 | 570 | 570 | 600 | 600 | 600 | 600 | 600 | 600 |
| Final pH | 4 | 4 | 4 | 4.5 | 4.7 | 4.5 | 5.0 | 5.52 | 5.3 | 5.37 |
| Shrinkage temperature (° C.) | 95 | 64 | 62 | 70 (73 after 2 days) | 74 | 75 | 70 (72 Next day) | 75 | 76 (76 Next day) | 76 |

The results from tables 3-5 show that aluminium based tanning agent chemicals have clearly a lower shrinkage temperatures compared to the compositions according to the present disclosure. Furthermore, in using the tanning agents according to the present disclosure there was no need to use buffering and/or basifying chemicals such as sodium formate and sodium bicarbonate. The chromium reference, TANKROM has a higher shrinkage temperature compared to the sample according to the present disclosure but the color hue of the sample was clearly bluish compared to whitish color of the other samples.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. In an embodiment, the term "about" can include traditional rounding according to the measuring technique and the numerical value. In addition, the phrase "about 'x' to 'y'" includes "about 'x' to about 'y'".

While only a few embodiments of the present disclosure have been shown and described herein, it will become apparent to those skilled in the art that various modifications and changes can be made in the present disclosure without departing from the spirit and scope of the present disclosure. All such modification and changes coming within the scope of the appended claims are intended to be carried out thereby.

We claim:

1. A method for manufacturing a composition suitable for leather tanning comprising zeolite treated with concentrated monocarboxylic acid, wherein the method comprises:

(i) providing zeolite having a Si to Al ratio of about 0.7 to 2.5 into a reactor, and (ii) keeping said zeolite in motion while introducing concentrated monocarboxylic acid selected from the group of consisting of: formic acid, acetic acid, propionic acid, glycolic acid, lactic acid, and a mixture thereof, wherein the concentration of said monocarboxylic acid being more than about 84% by weight, thereto, provided that the mean temperature of the resulting composition is maintained at a temperature of about 50° C. or below.

2. The method according to claim 1, wherein said introduction of concentrated monocarboxylic acid is performed by spraying.

3. The method according to claim 1, wherein said introduction of concentrated monocarboxylic acid is performed by spraying using a nozzle capable of atomizing the monocarboxylic acid solution.

4. The method according to claim 1, wherein the reactor is equipped with a cooling system.

5. The method according to claim 1, wherein said monocarboxylic acid is selected from the group consisting of: formic acid and acetic acid.

6. The method according to claim 1, wherein said monocarboxylic acid is formic acid.

7. The method according to claim 1, wherein said monocarboxylic acid is a concentrated acid more than about 90% by weight.

8. The method according to claim 1, wherein the ratio of monocarboxylic acid to zeolite is about 5 to 40% by weight.

9. The method according to claim 1, wherein the ratio of formic acid to zeolite is about 7 to 30% by weight.

10. The method according to claim 1, wherein the ratio of acetic acid to zeolite is about 7 to 35% by weight.

11. The method according to claim 1, wherein said zeolite is a basic zeolite.

12. The method according to claim 1, wherein said composition is a powdery solid having flowability equal to the zeolite before said monocarbozylic acid treatment.

13. A composition, comprising a leather tanning composition obtained by the method of claim 1, wherein the leather tanning composition is in a form of a powdery solid having a moisture content less than about 20% by weight comprising zeolite having a Si to Al ratio of about 0.7 to 2.5 treated with concentrated monocarboxylic acid selected from the group consisting of: formic acid, acetic acid, propionic acid, glycolic acid, lactic acid and mixtures thereof, wherein the concentration of said monocarboxylic acid being more than about 84% by weight, and having the zeolite structure intact.

14. The composition of claim 13, wherein said monocarboxylic acid is selected from the group consisting of: formic acid and acetic acid.

15. The composition of claim 13, wherein said monocarboxylic acid is formic acid.

16. The composition of claim 13, wherein said monocarboxylic acid is a concentrated acid more than about 90% by weight.

17. The composition of claim 13, wherein the ratio of monocarboxylic acid to zeolite is from about 5 to 40% by weight.

18. The composition of claim 13, wherein the ratio of formic acid to zeolite is from about 7 to 30% by weight.

19. The composition of claim 13, wherein the ratio of acetic acid to zeolite is from about 7 to 35% by weight.

20. The composition of claim 13, wherein said zeolite is a basic zeolite.

21. The composition of claim 13, wherein said composition is a powdery solid having flowability equal to the zeolite before said monocarbozylic acid treatment.

22. The composition of claim 13, wherein said composition further comprises a metal sulphate.

* * * * *